United States Patent [19]

Timmins et al.

[11] 4,127,393

[45] Nov. 28, 1978

[54] METHOD AND APPARATUS FOR VAPORIZING HYDROCARBON BASED LIQUIDS

[75] Inventors: Cyril Timmins, Winchester; Henry L. Conway; Henry J. F. Stroud, both of Solihull, all of England

[73] Assignee: British Gas Corporation, London, England

[21] Appl. No.: 818,726

[22] Filed: Jul. 25, 1977

Related U.S. Application Data

[63] Continuation of Ser. No. 647,204, Jan. 7, 1976, abandoned.

[30] Foreign Application Priority Data

Jan. 13, 1975 [GB] United Kingdom ..... 01289/75

[51] Int. Cl.[2] ..... C07C 9/04; C10C 13/30

[52] U.S. Cl. ..... 48/213; 208/107; 208/356; 208/362

[58] Field of Search ..... 208/57, 58, 107, 356, 208/362; 48/213

[56] References Cited

U.S. PATENT DOCUMENTS

| | | | |
|---|---|---|---|
| 1,710,240 | 4/1929 | Peterkin et al. | 208/356 |
| 1,953,939 | 4/1934 | Jones | 208/356 |
| 3,136,712 | 6/1964 | Van Driesen | 208/107 |
| 3,773,655 | 11/1973 | Stolfa | 208/107 |
| 3,842,138 | 10/1974 | Chahvekilian et al. | 208/107 |
| 3,870,481 | 3/1975 | Hegarty | 48/213 |
| 3,907,920 | 9/1975 | Starks | 208/107 |

*Primary Examiner*—Herbert Levine

*Attorney, Agent, or Firm*—Larson, Taylor and Hinds

[57] ABSTRACT

Apparatus and a process are provided whereby constituents of liquid mixtures eg non-distillate oils are vaporized under non-decomposing conditions in the presence of gases. Liquid components form a stream comprising the gas, vaporized and liquid constituents of the mixture are removed from the stream. Process may be employed to provide a vaporized feedstock for the non-catalytic thermal hydrogenation of hydrocarbon-based materials in the production of methane containing gases wherein the gas used for vaporization is the same as that used for the subsequent hydrogenation steps.

9 Claims, 2 Drawing Figures

Figure 1:
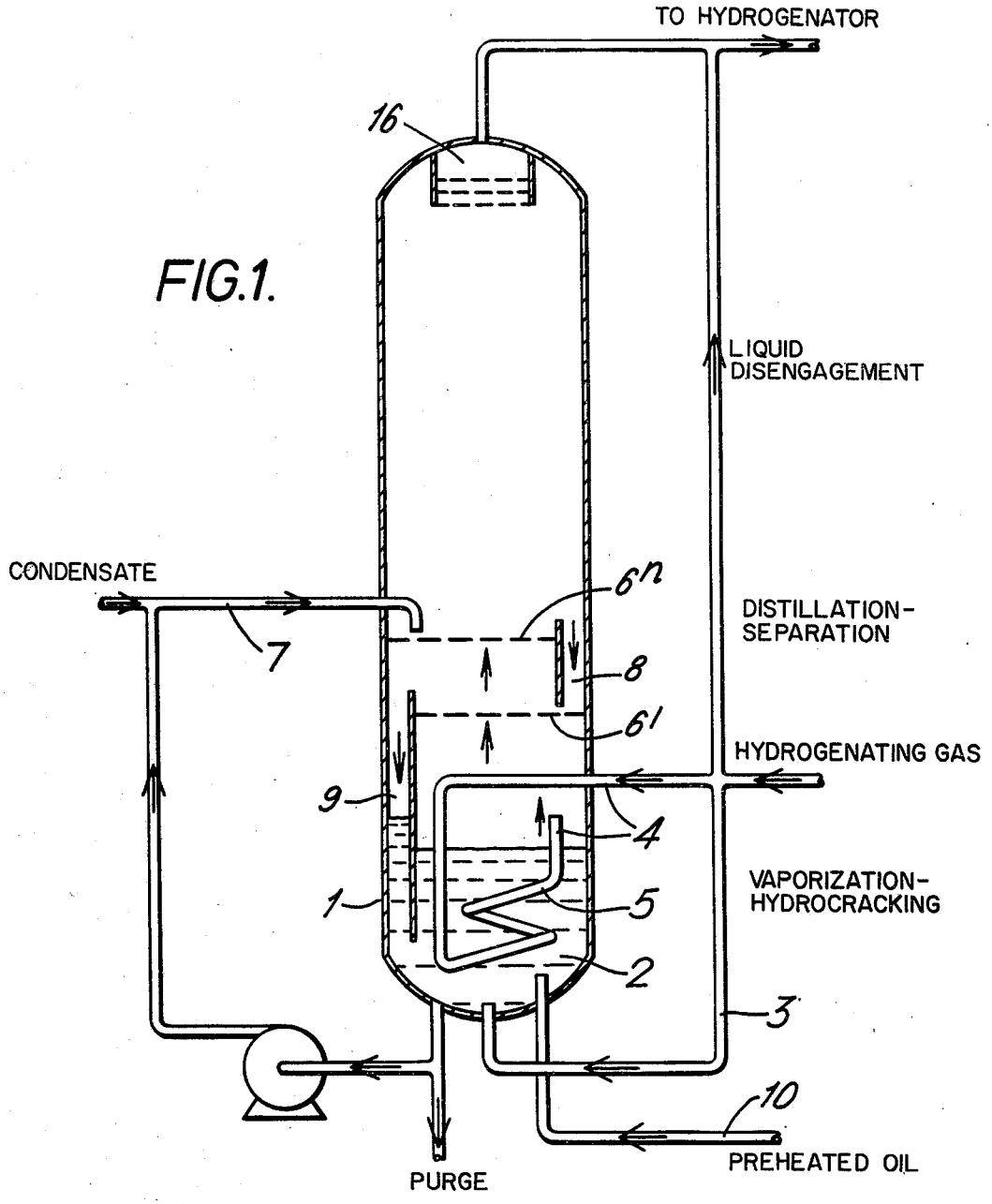

TO HYDROGENATOR
16
LIQUID DISENGAGEMENT
CONDENSATE
7
6n
DISTILLATION-SEPARATION
8
6'
HYDROGENATING GAS
9
4
1
5
VAPORIZATION-HYDROCRACKING
2
3
10
PREHEATED OIL
PURGE

CONDENSATE
PARTIAL CONDENSATION
TO HYDROGENATOR
LIQUID DISENGAGEMENT
16
14
11
12n
DISTILLATION-SEPARATION
13
12l
15
PURGE
PREHEATED OIL
6n
17
8
6l
DISTILLATION-SEPARATION
9
HYDROGENATING GAS
4
1
5
VAPORIZATION HYDROCRACKING
2
3

METHOD AND APPARATUS FOR VAPORIZING HYDROCARBON BASED LIQUIDS

This is a continuation of application Ser. No. 647,204 filed Jan. 7, 1976 now abandoned.

This invention relates to the vaporization of constituents of liquid mixtures, and in particular to the vaporization for the purposes of gasification of liquid hydrocarbon-based materials such as crude oils and fractions thereof. More particularly still, the present invention relates to the vaporization of such materials prior to their introduction into a reactor system whereby the materials are reacted to form methane-containing gases.

Many processes are known for the vapor phase reaction of hydrocarbon based materials to produce a variety of products, methane-containing gases being but one example. Such processes may be catalytic ones, for example, British Gas Corporation's Catalytic Rich Gas (CRG) process for the catalytic steam reforming of hydrocarbons to produce a methane-rich gas or non catalytic ones such as the thermal hydrogenation or hydrogenolysis of hydrocarbons to produce, again for example, methane-containing gas. Examples of processes in which non-catalytic gas-vapor reactions for producing methane-containing gases take place are the British Gas Corporation's Fluidised Bed Hydrogenator (FBH) Process and the Gas Recycle Hydrogenator (GRH) Process.

The Gas Recycle Hydrogenator is so designed as to require the reactions to take place predominantly in the vapor phase; it therefore required the feedstock either to be vaporized before introduction or to be introduced, for example, by atomization, in such a way that evaporation takes place almost instantly. Preferred feedstocks are therefore comparatively light distillate oils, such as certain fractions of crude petroleum, certain other refinery products, or the lightest crude oils themselves. The heavier and bottoms fractions of most crudes have therefore been unavailable for this process. The GRH may be operated at temperatures up to 950° C. typically about 900° C. In the Fluidized Bed Hydrogenator the oil is introduced, having been preheated, by atomization. Since complete vaporization is not required, the range of oils available is therefore considerably wider.

Conventional distillation of crude petroleum is ill adapted to raising the proportion of the oil that can be vaporized. In the case of light crude oils where the required vapor fraction can be produced by conventional distillation, subsequent heat treatment must involve condensation, pressure increase to that of the aforesaid FBH or GRH processes and preheating to the required temperature. A disadvantage of this is that coking of the distillate oil is known to occur in this preheat stage. With heavier crude oils it may not be possible to obtain the required proportion of oil as vapor in the conventional distillation column as heat treatment of the heavier fraction and bottoms causes polymerization and carbonization.

The object of the present invention is to increase the proportion of an oil that can be obtained as vapor for direct use in the aforesaid and similar processes, a feature of which is that they customarily operate under pressure. The present invention also has the feature that even when the gasification reactor can accept the feedstock oil at least partly as liquid, as the FBH, potentially troublesome constituents such as asphaltenes, solids and metal contaminants can be reduced or eliminated. Thus, in the GRH and FBH no intermediate treatment of the vaporized oil needs to be contemplated. In a catalytic process, the vaporized oil will need to be subjected to pretreatment, such as desulphurization, and perhaps to hydrocracking, before it can be gasified with steam as in the CRG process.

The invention thus provides apparatus for the vaporization of constituents of liquid mixtures, such as mixtures of hydrocarbon-based liquids, comprising a closed vessel provided with separate means for introducing gas and liquid into the lower end and means for removing vapor mixed with the gas, the interior of the vessel defining three zones, an upper zone, a lower zone and an intermediate zone between said upper and lower zones, such that in use said lower zone contains liquid to be vaporized, the upper zone contains vapor mixed with gas substantially free from entrained liquid and said intermediate zone contains ascending gas and vapor together with entrained liquid, wherein said intermediate zone is provided, at its lower end, with means for introducing an ascending stream of gas into said zone and means at its upper end, comprising a plurality of surfaces, for seaprating the liquid from the gas and vapor mixture.

The surfaces may be in the form of bubble cap plates, similar to those employed for fractional distillation, or they may be other tray configurations. In addition to extending transversely across the interior of the reaction vessel, the plurality of surfaces may extend upwardly to provide a series or stack of such surfaces. Alternatively, for certain oils, a conventional column packing such as Raschig rings, Pall rings or knitted wire mesh can provide the contacting surfaces.

The present invention also provides a method for vaporizing constituents of liquid mixtures, for instance, hydrocarbon-based liquids such as non-distillate oils, which method comprises preheating said liquid to a temperature which is less than the temperature at which decomposition occurs, admixing the preheated liquid with a gas that is supplied at a temperature greater than the temperature of said liquid, contacting the thus formed mixture comprising gas, vapor and liquid with a solid surface and thereafter returning the separated liquid to the main mass of liquid undergoing vaporization. When the invention is used for the vaporization of oils prior to gasification of the vapor, the gas is preferably a hydrogen-containing gas, and the operation is conducted under pressure. The temperature used in the lower zone can be higher than the maximum possible operating temperature of a conventional distillation unit because the presence of hydrogen at pressure substantially reduces coking reactions.

It is preferred to provide for, or to increase, the amount of liquid on the surfaces which form the boundary between the upper and the intermediate zone, which are the surfaces which enable the liquid, generally in the form of droplets, to be separated from the gas and vapor mixture. This may be done by supplying a suitable liquid, for instance, a hydrocarbon oil, through a pipe delivering onto the upper surface of one or more of the bubble cap trays, where these are used. Alternatively a riser may be provided connecting the lower zone directly with the upper regions of the vessel, with means, such as a pump for causing liquid to be delivered from the lower zone onto the upper surface of a bubble cap tray.

Such methods for irrigating the bubble cap tray or trays may be used in combination. Whether or not provision is made to irrigate the trays, provision must be made to return the liquid from the lowermost surface to the lower zone by a downcomer such that the returning liquid is not in contact with the ascending mixture at the middle and lower regions of the intermediate zone. If the surfaces are arranged in stacks, liquid leaving an upper surface may be used to irrigate a lower surface and liquid from the lowermost surface is returned to the lower zone as described.

The advantage of this procedure resides in the fact that the bubble cap tray or similar system may be so designed as to cause entrained oil present as liquid to be absorbed and thus withdrawn from the gas and vapour by the irrigating liquid. Furthermore, the rate at which the irrigating liquid is supplied to the bubble cap trays and their design will control the liquid hold-up time on the trays which is desirable since excessive hold-up time can lead to carbonisation of the componenets of the separated liquid droplets. Since packed columns can form dead regions in which there are extremely long hold-up times, it is preferred for this reason to employ bubble cap plates or similar systems as the contacting surfaces.

The solid surfaces for contacting with the liquid components to be separated from the vapour may be at substantially the same temperature as the main mass of liquid to be vaporised. The surfaces may, however, be as much as 10° or 20° C. lower than the temperature of the main liquid mass.

The method and apparatus of the invention may be modified to permit other materials to be vaporised in addition to the main liquid feedstock. Thus, where the vaporization is employed as part of a gas making process in which hydrocarbon condensates are produced during the main gasification reaction or subsequent treatment of the gasified products, these condensates may be added to the feedstock liquid. The condensate may be added directly to the preheated liquid, or to the liquid to be preheated, or be fed to the surfaces forming the boundary between the intermediate and upper zones. The last possibility has the advantage of allowing vaporization of any volatile constituents of the condensate.

The description that follows relates to the circumstances when the liquid is a hydrocarbon oil and the vapor is intended to undergo gasification. The gas is then a hydrogen-containing gas and the liquid is vaporised under hydrogenating conditions. The amount of liquid, its temperature and the hydrogen partial pressure will together determine the degree of vaporization and the extent to which hydrogenation and cracking reactions take place. The amount vaporized can be more than that obtained when no reactions occur under otherwise similar conditions. Under conditions of high temperature and pressure with turbulent mixing much of the residual liquid will be entrained in the rising vapor and gas in the form of spray droplets or foam. This rising may then be contacted with further amounts of heated hydrogen-containing gas. The effect of adding further heated gas reduces condensation of the vapor when it contacts the separation surfaces by heating the liquid and also by reducing its partial pressure. The added gas will also aid the stripping of vapor from the entrained liquid. Its use will also prevent stagnation of the oils on the surfaces of the plates and this is desirable because such oils under these conditions have a tendency to coke formation. However, excess amounts of added gas may cause excessive foam formation which is to be avoided. Additional gas may be added downstream of the separation surface to avoid condensation of the evaporated oil.

It will be appreciated that the gas as introduced at each of the positions need not have all the same composition; for instance it may be convenient to add steam to the hydrogenating gas in the intermediate zone.

The hydrogen-containing gas added at the intermediate and upper zone of the vessel may first be conducted through the main mass of liquid to be vaporised, prior to its discharge into the vessel. Thus, this added hydrogen-containing gas may be employed for heating the preheated liquid to be vaporized in indirect heat exchange.

For fear that traces of oil droplets may approach the outlet of the evaporator, as may happen if there is malfunctioning, the outlet may be provided with suitable demisting apparatus.

The vessel can operate at pressures above atmospheric, so allowing the hot vapor and hydrogenating gas to pass directly to a further reaction stage without intermediate cooling or heating as would be the case with an atmospheric or vacuum distillation unit.

The pressure at which the process of the invention is operated will generally be related to that of the downstream processes, for example, the GRH, FBH or hydrocracking stage. These downstream processes are hereinafter described by reference to patent specifications whose disclosures are incorporated herein by reference. Similarly it it not possible to quantify the temperatures at which the process may be operated since this depends upon factors such as the operating pressure, type of oil feedstock, ratio of hydrogen to oil in the vaporiser and the amount of cracking which occurs. However, generally the process of the invention may be operated at temperatures up to about 550° C. and may typically range from 350° C. to 500° C.

The ratio of hydrogenating gas to hydrocarbon-based feedstock employed in the process of the present invention will also depend upon a number of factors such as the nature of the feedstock, the degree of vaporization required and even, in some cases, the hydrogen/carbon ratio required for the downstream process to which the product of the invention is to be subjected, for example, methane synthesis by GRH route. Generally, however, the ratio of hydrogen to feedstock may range from 5 to 70 standard cubic feet per pound of feedstock and may typically range from 10 to 55 scf/lb. In those cases where the process of the invention is applied to the provision of vaporized feedstocks for the synthesis of methane by non-catalytic hydrogenation routes such as the GRH or FBH routes the overall ratio of hydrogenating gas to feedstock may range from 30 to 90 scf/lb, preferably 35 to 65 scf/lb. Thus, a portion of the hydrogenating gas required for the hydrogenation reactions may be first employed to vaporize the feedstock in accordance with the process of this invention.

Embodiments of the invention will be described by way of example, with reference to the accompanying drawings which are diagrammatic sectional views of a vaporizer in accordance with the invention.

Referring to FIG. 1, a vessel 1 contains a preheated oil 2 to be vaporized. Preheated oil to be vaporized is fed into the main oil mass 2 within vessel 1 via pipe 10. Hydrogenating gas is supplied via pipe 3, to heat the oil directly and to cause turbulent mixing within the oil. Oil vapour containing entrained droplets of liquid oil ascends and is admixed with a concurrent stream of a further supply of hydrogenating gas delivered through pipe 4. Prior to discharge the gas in pipe 4 is led through the oil 2 and part of its heat is exchanged with the oil in heat exchanger 5. The gas-vapor mixture then contacts a series of tray configurations $6^1$ which are arranged in stacks $6^1$ $6^n$. The gas-vapor mixture contacts the bottom surfaces of the trays. The top surfaces of the trays are contacted with a liquid comprising the oil and optionally a condensate derived from a hydrogenation reactor (not shown). This liquid is delivered into the reactor via pipe 7 and returns to the main oil mass 2 via downcomers 8 and 9, together with oil which has been separated from the vapor. The gas-vapor mixture, after leaving the area of tray $6^n$ is then contacted with a demisting pad 16 and is passed to the hydrogenator (not shown) or other gas making apparatus. Non-vaporizable oil residues may be removed from the bottom of vessel 1.

Figure 2:
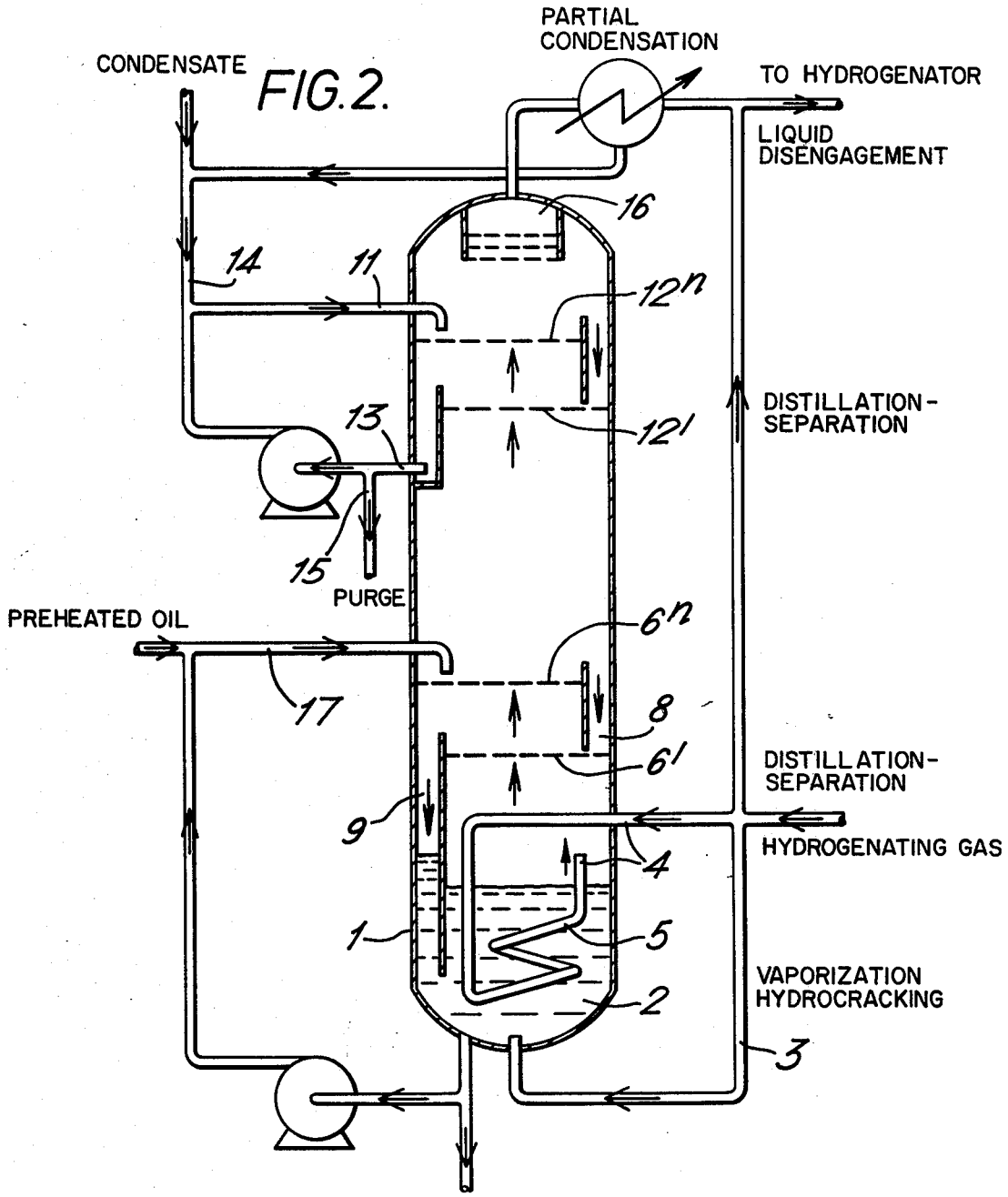

In the case where a liquid is available, preferably from within the process, with a vapor pressure which is sufficiently low that a substantial portion will remain as liquid in the intermediate zone of the vaporizer, it is of advantage to use this as the irrigating liquid in a secondary vapor/liquid contacting section within the intermediate zone in the manner shown in FIG. 2. Where the vapor product from the upper zone is used in a hydrogenation process the hydrocarbon condensate derived from the hydrogenation stage may contain constitutents with the desired characteristics or alternatively partial condensation of the vapor product may itself provide the liquid. The liquid derived from the above is introduced through pipe 11 to the top surface of the grays $12^1$–$12^n$ which can be of the type previously described. The liquid is withdrawn from the lowermost tray via pipe 13 and pumped back through pipe 11. Make-up liquid is supplied to this loop through pipe 14 and a purge removed from pipe 15 to maintain the liquid characteristics as required.

With the secondary tray surfaces it is still of advantage to circulate the main oil mass 2 to the surfaces $6^1$–$6^n$ as this provides a preliminary vapor cleaning system so reducing the amount of entrained liquid droplets entering the liquid loop on the upper surfaces $12^1$–$12^n$ whilst also providing a further stripping of the products of cracking in the main oil mass by the gas introduced through pipe 4 in the lower zone. In this embodiment the feed oil is introduced into the oil circulation line 17 as an alternative to being introduced directly into the main oil mass 2, the size and design of the bubble cap plates or other tray configurations are such as to reduce foam problems and the liquid flow rates are set to achieve good vapor/liquid separation and to avoid coke-forming conditions. The tray seapration distances are also chosen to avoid foam carry-over.

The following Examples are provided to illustrate the present invention.

EXAMPLE 1

In a vaporizer similar to that described and operating at 600 psig, a heavy crude oil of API gravity 12° was treated continuously. With the lower zone of the vaporizer maintained at 440° C., 58% by weight of the crude oil was vaporized in a supply of 37 $ft^3$ of hydrogen (measured at standard reference conditions) per lb of oil, and the vapor when condensed had an API gravity of 23°. The mixture of this vapor and hydrogen was fed directly to a GRH reactor operated at 890° C. and at a pressure of 580 psig. Typical distillation of this crude oil would yield 37% by weight of distillates having an API gravity of 27°.

EXAMPLE 2

In a vaporizer similar to that shown in FIG. 2 and operating at 600 psig, a topped crude oil of API gravity 23° was treated continuously with the lower and intermediate zones of the vaporizer maintained at 440° C. and the upper zone at 430° C. Hydrogen was supplied at the rate of 44 $ft^3$ (measured at standard reference conditions) per lb of topped oil and the overall vaporization was 75% by weight the condensed vapor having an API gravity of 33°. The topped oil feedstock was mixed with recycled redidue in the oil circulating line 17 in the proportion 2 lb of oil feedstock per 1 lb of residue before being introduced into the vaporizer. The surfaces of the upper zone were irrigated by recirculating liquid through lines 11 and 13 at the rate of 1 lb of liquid per 1 lb of vaporized oil, the composition of the irrigating liquid being maintained by a small purge through line 15 and make up by partial condensation of a small amount of the vaporized oil. The vaporized oil and hydrogen mixture passed forward to a GRH reactor operated at 890° C. and 580 psig.

EXAMPLE 3

In a vaporizer similar to that shown in FIG. 1 and operated at 600 psig, a light crude oil of API gravity 35° was treated continuously. With the lower zone of the vaporizer maintained at 400° C., 75% by weight of the crude oil was vaporized in a supply of 50 $ft^3$ = (measured at standard reference conditions) of hydrogen per lb of crude oil and the vapor had an API gravity of 40°. The mixture of oil vapor and hydrogen passed forward to a GRH reactor operated at 750° C. and 590 psig.

Although the method and apparatus of the invention may be employed to vaporize components of a liquid for any purpose, the invention is particularly useful in the field of manufacturing methane-containing gases. The invention may be used to vaporize and partially hydrogenate or crack oils which are used as feedstocks for the processes described in our U.K. patent specifications Nos. 830,960; 899,574; 1,031,717; 1,074,932; 1,085,613; 1,122,426; 1,133,483; 1,154,321 and 1,219,916 which are incorporated herein by reference. Alternatively the oil vaporized in accordance with the invention may be subjected to a further hydrocracking and/or desulphurization treatment and thereafter subjected to catalytic reforming processes such as are described in our U.K. patent specifications Nos. 820,257; 994,278; 969,637; 1,150,066; 1,155,843; 1,196,413; 1,198,991; 1,228,131; 1,265,481 and 1,271,721 which are also incorporated herein by reference.

We claim:

1. A process for vaporizing constituents of a whole or topped crude oil comprising:

pre-heating said crude oil to a temperature which is less than the temperature at which decomposition of said crude oil occurs;

introducing said pre-heated crude oil into the lower end of a vessel to form a main mass of crude oil;

introducing a first hydrogen-containing gas stream pre-heated to a temperature greater than that of said main mass into said main mass with turbulent mixing sufficient to entrain oil in a rising stream comprising said gas and vaporized components of said crude oil;

passing a second hydrogen-containing gas stream pre-heated to a temperature greater than that of the main mass of crude oil in indirect heat exchange with said main mass in said vessel and thereafter into admixture with said rising stream of said gas, vaporized components, and entrained oil to pass upwardly therewith in said vessel;

contacting said rising stream of said gas, vaporized components, and entrained oil with a solid surface located in said vessel above said main mass to remove entrained oil from the rising stream;

returning the removed oil to the main mass undergoing vaporization; and withdrawing from the vessel the rising stream of gas and vapor from which said entrained oil has been removed.

2. A process according to claim 1 wherein said liquid material comprises a heavy whole or topped crude oil.

3. A process according to claim 1 wherein the temperature of the solid surface ranges from substantially the same temperature as the mixture of pre-heated oil and gas to not more than about 20° C. below the temperature of the pre-heated liquid/gas mixture.

4. A process according to claim 1 wherein said vaporization is carried out at a temperature up to about 550° C.

5. A process according to claim 4 wherein the temperature is from 350° C. to 500° C.

6. A process according to claim 1 wherein the ratio of hydrogen-containing gas to crude oil is from 5 to 7 scf/lb of material.

7. A process for the production of methane-containing gases by the non-catalytic vapor-phase hydrogenation of whole or topped crude oil comprising:

pre-heating said crude oil to a temperature which is less than the temperature at which decomposition of said crude oil occurs;

introducing said pre-heated crude oil into the lower end of a vessel to form a main mass of crude oil;

introducing a first hydrogen-containing gas stream pre-heated to a temperature greater than that of the main mass of crude oil into said main mass with turbulent mixing sufficient to entrain oil in a rising stream comprising said gas and vaporized components of said oil;

passing a second hydrogen-containing gas stream pre-heated to a temperature greater than that of the main mass of crude oil in indirect heat exchange with said main mass in said vessel and thereafter into admixture with said rising stream of said gas, vaporized components, and entrained oil to pass upwardly therewith in said vessel;

contacting said rising stream of said gas, vaporized components, and entrained oil with a solid surface located in said vessel above said main mass to remove entrained oil from the rising stream;

returning the removed oil to the main mass of oil undergoing vaporization;

withdrawing from the vessel the rising stream of gas and vapor from which said entrained oil has been removed; and subjecting the withdrawn gas and vapor to a non-catalytic hydrogenation reaction at a temperature of not greater than 950° C.

8. A process according to claim 7 wherein the total amount of hydrogen-containing gas added to said oil in both the vaporization and hydrogenation stages ranges from 30 to 90 scf $H_2$/lb oil.

9. A process according to claim 7 wherein said oil consists essentially of a heavy whole or topped crude oil.

* * * * *